US008456498B2

(12) United States Patent
Shoji et al.

(10) Patent No.: US 8,456,498 B2
(45) Date of Patent: Jun. 4, 2013

(54) PRINTING APPARATUS

(75) Inventors: Noriyoshi Shoji, Chiba (JP); Tomoki Ogura, Chiba (JP); Kouhei Miyawaki, Chiba (JP); Norimitsu Sanbongi, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 13/200,249

(22) Filed: Sep. 21, 2011

(65) Prior Publication Data

US 2012/0098916 A1 Apr. 26, 2012

(30) Foreign Application Priority Data

Oct. 22, 2010 (JP) ..... 2010-237589

(51) Int. Cl.
*B41J 2/35* (2006.01)
*B41J 2/365* (2006.01)
*B41J 2/37* (2006.01)

(52) U.S. Cl.
USPC ..... 347/188; 347/192

(58) Field of Classification Search
USPC ..... 347/188, 192; 400/120.09, 120.12
See application file for complete search history.

(56) References Cited

U.S. PATENT DOCUMENTS

2009/0174410 A1* 7/2009 Kim et al. ..... 324/426

FOREIGN PATENT DOCUMENTS

JP 62-213524 * 9/1987
JP 05-80896 * 4/1993
JP 05345437 12/1993

OTHER PUBLICATIONS

Machine-generated translation of JP 05-080896, published Apr. 1993.*

* cited by examiner

*Primary Examiner* — Huan Tran
(74) *Attorney, Agent, or Firm* — Adams & Wilks

(57) ABSTRACT

A printing apparatus includes a printing unit for performing printing by pressing a thermal head onto heat sensitive paper to heat the heat sensitive paper. A battery supplies a voltage to the thermal head, and a battery voltage detecting unit detects the voltage. A printing control unit changes, according to the detected voltage, a power-off time in which power supply from the battery to the thermal head is stopped. The printing control unit calculates the power-off time based on the detected voltage and the resistance of the thermal head and shortens the power-off time as the detected voltage becomes lower thereby shortening the overall printing time without shortening the life of the heating resistance elements of the thermal head.

5 Claims, 5 Drawing Sheets

T1

| POWER SOURCE VOLTAGE [V] | POWER-OFF TIME [μs] |
|---|---|
| 2.5 | 5 |
| 3 | 25 |
| 3.5 | 40 |
| 4 | 55 |
| 4.5 | 70 |
| 5 | 85 |
| 5.5 | 100 |

PRINTING APPARATUS

BACKGROUND OF THE INVENTION

1. Field of the Invention

The present invention relates to a printing apparatus.

2. Description of the Related Art

In a thermal printer, when power is successively supplied to a heating resistance element of a certain thermal head, there is provided a power-off time, in which the power supply is stopped, between a power-on time in which power is supplied to the heating resistance element for printing one-line data and a power-on time in which power is supplied to the heating resistance element for printing succeeding one-line data. The power-off time is provided for the purpose of avoiding a trailing phenomenon, and further, attaining a longer life of the heating resistance element of the thermal head (see, for example, Japanese Patent Application Laid-open No. Hei 5-345437).

Conventionally, the power-off time in which the power supply is stopped is set so as not to shorten the life of the heating resistance element of the thermal head even when a voltage for supplying power to the thermal head (hereinafter, referred to as "power supply voltage") is high. The power-off time in which the power supply is stopped is kept constant irrespective of the power supply voltage.

Therefore, when the power supply voltage is low, the power-off time is unnecessarily long even though a shorter power-off time suffices as compared to the case where the power supply voltage is high. Thus, there is a problem in that, when the voltage is low, it takes a longer period of time to print a predetermined number of lines (hereinafter, referred to as "overall printing time").

SUMMARY OF THE INVENTION

The present invention has been made in view of the above-mentioned problem, and it is therefore an object of the present invention to provide a printing apparatus capable of shortening an overall printing time without shortening a life of a heating resistance element of a thermal head.

In order to solve the above-mentioned problem, according to an aspect of the present invention, there is provided a printing apparatus, including: a printing unit for performing printing by pressing a thermal head onto heat sensitive paper to heat the heat sensitive paper; a power source unit for supplying a voltage to the thermal head; a voltage detecting unit for detecting the voltage; and a printing control unit for changing, according to the detected voltage, a power-off time in which power supply from the power source unit to the thermal head is stopped.

In the printing apparatus, the printing control unit may shorten the power-off time as the detected voltage becomes lower.

In the printing apparatus, the printing control unit may calculate the power-off time based on the detected voltage and a resistance of the thermal head.

In the printing apparatus, the printing control unit may calculate electric power based on the detected voltage and the resistance of the thermal head, and calculate the power-off time using a linear function of the electric power.

According to the present invention, when the voltage is low, it is possible to shorten the overall printing time without shortening the life of the heating resistance element of the thermal head.

DETAILED DESCRIPTION OF THE PREFERRED EMBODIMENT

Figure 1:
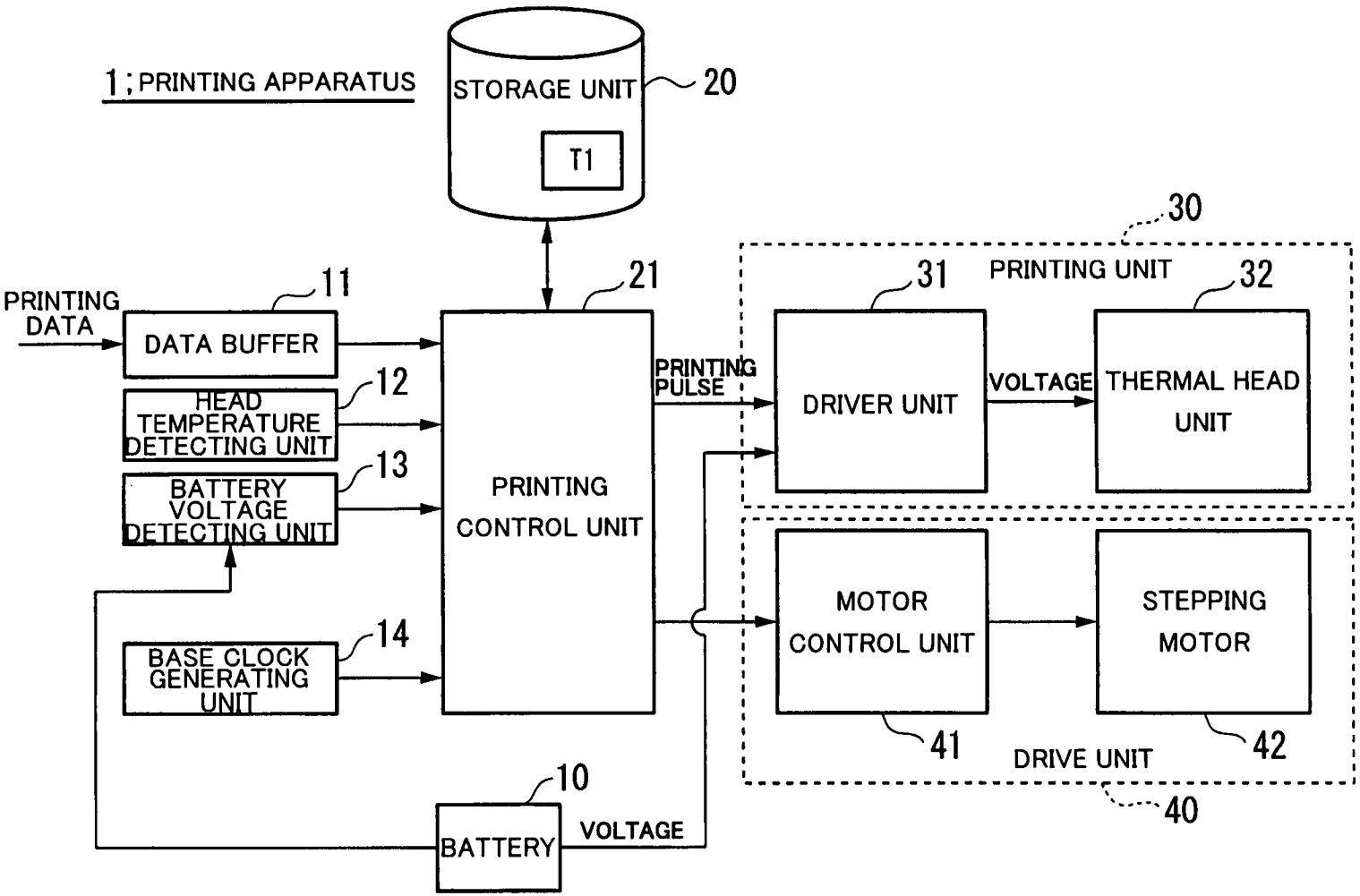
FIG. 1 is a block configuration diagram of a printing apparatus according to an embodiment of the present invention.

Hereinbelow, an embodiment of the present invention is described in detail with reference to the accompanying drawings. FIG. 1 is a block configuration diagram of a printing apparatus 1 according to the embodiment of the present invention. The printing apparatus 1 includes a battery (power source unit) 10, a data buffer 11, a head temperature detecting unit 12, a battery voltage detecting unit (voltage detecting unit) 13, a base clock generating unit 14, a storage unit 20, a printing control unit 21, a printing unit 30, and a drive unit 40.

Further, the printing unit 30 includes a driver unit 31 and a thermal head unit 32. The drive unit 40 includes a motor control unit 41 and a stepping motor 42.

The battery 10 supplies a voltage to the driver unit 31 of the printing unit 30.

In the data buffer 11, printing data input from a printing data providing apparatus (not shown) is accumulated.

The head temperature detecting unit 12 detects the temperature of the thermal head unit 32, and outputs information indicating the detected temperature to the printing control unit 21.

The battery voltage detecting unit 13 detects the voltage of the battery 10, and outputs information indicating the detected voltage to the printing control unit 21.

The base clock generating unit 14 generates a clock signal for operating the printing control unit 21, and outputs the generated clock signal to the printing control unit 21.

The storage unit 20 stores, in association, the information indicating the voltage of the battery 10, and information indicating a power-off time $T_{OFF}$ in which power supply is stopped between a power-on time in which power is supplied to a heating resistance element of the thermal head unit 32 for printing one-line data and a power-on time in which power is supplied to the heating resistance element for printing succeeding one-line data.

Now, a relationship between the power-off time $T_{OFF}$ and a voltage V of the battery 10 is described. When electric power to be supplied to the thermal head unit 32 is assumed as "P", the power-off time $T_{OFF}$ is calculated by the following expression as a linear function of the supplied voltage P, and is stored in the storage unit 20 in advance.

$$T_{OFF}=a\times P+b \quad (1)$$

In this expression, "a" and "b" represent predetermined coefficients. The coefficients "a" and "b" are set so that, when the voltage of the battery 10 is a lower limit (for example, 2.5 V), the power-off time $T_{OFF}$ takes a first power-off time (for example, 5μs to 80 μs) that is close to 0 seconds, and when the voltage of the battery 10 is an upper limit (for example, 5.5 V), the power-off time $T_{OFF}$ takes a second power-off time (for example, 100 μs) that is longer than the first power-off time. For example, "a" takes a value of from 0.3 to 0.6, and "b" takes a value of from −0.01 to 0.

When the voltage of the battery 10 is assumed as "V", and a resistance value of the thermal head unit 32 is assumed as "R", the applied electric power P is expressed by the following expression based on the Ohm's law.

$$P=V\times V/R \tag{2}$$

The printing control unit 21 reads the printing data from the data buffer 11. Further, the printing control unit 21 reads, from the storage unit 20, the information indicating the power-off time $T_{OFF}$ according to the information indicating the voltage of the battery 10 that is input from the battery voltage detecting unit 13.

Based on information indicating the temperature that is input from the head temperature detecting unit 12, and the information indicating the voltage of the battery 10 that is input from the battery voltage detecting unit 13, the printing control unit 21 calculates the power-on time, in which power is supplied to the thermal head unit 32 of the printing unit 30. Specifically, for example, the printing control unit 21 calculates a power-on time $T_{ON}$ using the following expression based on the Joule's law ((electric power)×(time)=(energy)).

$$T_{ON}=E\times R\times C/(V^2) \tag{3}$$

In this expression, "E" represents energy necessary to develop a color on heat sensitive paper (hereinafter, referred to as "printing energy"), and "C" represents a correction coefficient based on a power supply cycle of a printing pulse (corresponding to printing speed) that is output from the printing control unit 21 to the driver unit 31. The printing pulse herein refers to a signal for specifying the power-on time in which power is supplied to each heating resistance element of the thermal head unit 32 for printing one line, and the power-off time in which the power supply is stopped after the printing of one line until the start of printing of a succeeding line.

Specifically, for example, the printing pulse is a pulse signal maintained at a predetermined voltage (High) during the power-on time in which power is supplied to the heating resistance element of the thermal head unit 32, and maintained at a voltage (Low) lower than the predetermined voltage during the power-off time. Further, the power supply cycle is a sum of the power-on time for one line and the power-off time for one line.

Because the temperature of the heating resistance element of the thermal head unit 32 spontaneously decreases during the power-off time, the correction coefficient C is introduced for correction in a case where the ratio of the power-off time to the power-on time becomes larger.

Further, the printing energy E in the expression (3) varies depending on a temperature T of the thermal head unit 32, and therefore the printing control unit 21 calculates the printing energy E by a function f(T) of the temperature T of the thermal head unit 32. Here, f(T) is a function determined by sensitivity of the heat sensitive paper or other factors.

Note that, in this embodiment, the power-on time $T_{ON}$ is corrected using the correction coefficient C based on the power supply cycle of the printing pulse, but the present invention is not limited thereto. Alternatively, resistance value correction, power supply dot count correction, or trailing correction may be performed. The resistance value correction herein refers to correction of the power-on time $T_{ON}$ by calculating a wiring resistance value or a driver-ON resistance from an exact equivalent circuit of the thermal head. Further, the power supply dot count correction refers to correction of the power-on time $T_{ON}$ according to the number of times of power supply to each heating resistance element, because the voltage drop is great in a case where the number of times of power supply is large. The trailing correction refers to correction of the power-on time $T_{ON}$ based on a count of cumulative power supply dots.

In order to supply a voltage for heating the heat sensitive paper to each heating resistance element of the thermal head unit 32, the printing control unit 21 uses the read information indicating the power-off time $T_{OFF}$ and the calculated information indicating the power-on time $T_{ON}$, to thereby generate a printing pulse for each heating resistance element, which is high in voltage at a position at which the printing is to be performed on the heat sensitive paper and is low in voltage at a position at which the printing is not to be performed on the heat sensitive paper. The printing control unit 21 outputs each generated printing pulse to the driver unit 31. Specifically, for example, the printing control unit 21 generates a pulse signal that is high during the power-on time and is low during the power-off time.

Note that, the printing control unit 21 controls each heating resistance element of the thermal head unit 32 by generating the printing pulse that is high in voltage at a position at which the printing is to be performed and is low in voltage at a position at which the printing is not to be performed. However, the present invention is not limited thereto, and the printing control unit 21 may control each heating resistance element of the thermal head unit 32 by generating a printing pulse that is low in voltage at a position at which the printing is to be performed and is high in voltage at a position at which the printing is not to be performed.

The printing control unit 21 generates the printing pulse so that, when the voltage of the battery 10 is low, the power-off time after the printing for one line becomes shorter as compared to the case where the voltage of the battery 10 is high.

When the printing for one line is finished, the printing control unit 21 controls the motor control unit 41 to perform paper feeding for one line. Specifically, for example, when the printing for one line is finished, the printing control unit 21 outputs, to the motor control unit 41, a command signal for commanding the motor control unit 41 to perform paper feeding for one line.

When the voltage of the printing pulse input from the printing control unit 21 is high, the driver unit 31 supplies, to the thermal head unit 32, the voltage that is supplied from the battery 10. When the voltage of the printing pulse input from the printing control unit 21 is low, the driver unit 31 stops supplying the voltage to the thermal head unit 32.

For each heating resistance element of the thermal head unit 32, the thermal head unit 32 performs printing by heating the heat sensitive paper using the applied voltage for one line, which is supplied from the driver unit 31.

Based on the command signal input from the printing control unit 21, the motor control unit 41 generates a motor driving pulse voltage with the number of pulses necessary for the stepping motor to perform paper feeding for one line, and supplies the generated pulse voltage to the stepping motor 42.

The stepping motor 42 rotates a roller using the pulse voltage supplied from the motor control unit 41, to thereby perform paper feeding for one line.

Figures 2, 3:
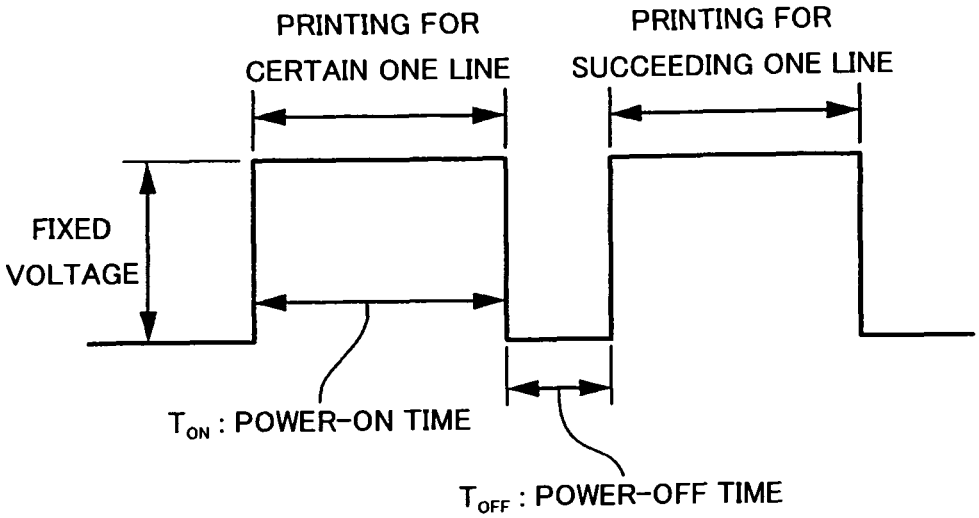
FIG. 2 is a diagram illustrating an example of a printing pulse generated by a printing control unit.
FIG. 3 is an example of a table associating a voltage of a battery and a power-off time which are stored in a storage unit.

FIG. 2 is a diagram illustrating an example of the printing pulse generated by the printing control unit 21. In FIG. 2, the axis of abscissa represents time, and the axis of ordinate represents a voltage. FIG. 2 illustrates a printing pulse for instructing a certain heating resistance element of the thermal head unit 32 to successively perform printing for two lines. FIG. 2 illustrates the power-on time $T_{ON}$, in which power is supplied to the heating resistance element for printing certain one line, and the power-off time $T_{OFF}$, in which the power supply to the heating resistance element is stopped, between the power-on time for printing the certain one line and the power-on time for printing succeeding one line.

FIG. 3 is an example of a table Ti associating the voltage of the battery 10 and the power-off time which are stored in the storage unit 20. FIG. 3 shows that the power-off time is short when the voltage of the battery 10 is low, and the power-off time is long when the voltage of the battery 10 is high. Further, when the voltage of the battery 10 is the lower limit of 2.5 V, the power-off time is 5 is that is close to 0 seconds.

Figure 4:
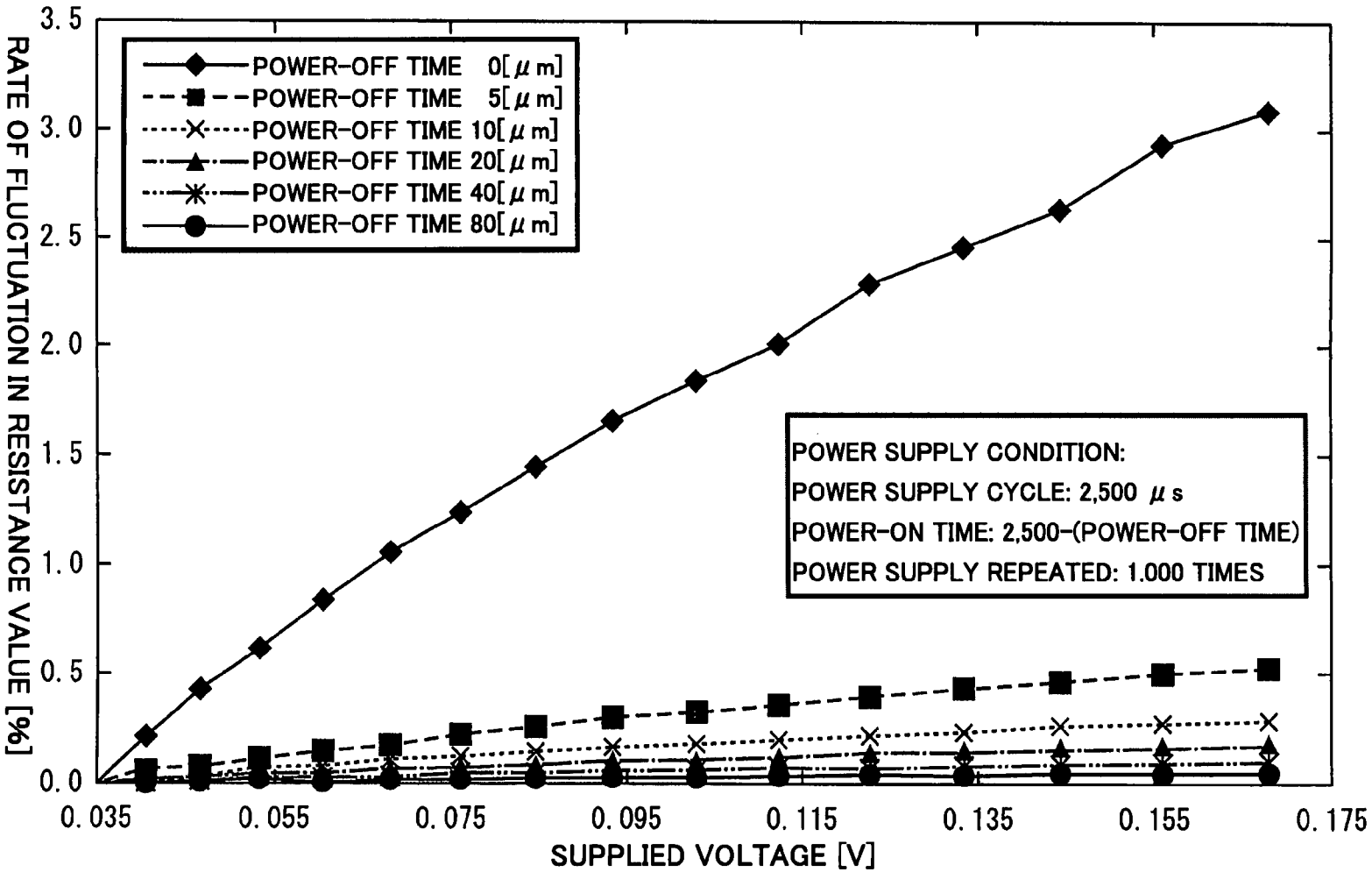
FIG. 4 is a graph showing a relationship between an applied electric power and a rate of fluctuation in resistance value of a thermal head unit after power supply is repeated.

Now, description is given of the reason why the first power-off time is set to a period of time close to 0 seconds but is not exactly set to 0 seconds. FIG. 4 is a graph showing a relationship between a supplied voltage and a rate of fluctuation in resistance value of the thermal head unit 32 after the power supply is repeated. In FIG. 4, the axis of abscissa represents a supplied voltage, and the axis of ordinate represents a rate of fluctuation in resistance value. This means that, as the rate of fluctuation in resistance value is higher, the heating resistance element of the thermal head unit 32 is more deteriorated.

FIG. 4 shows a relationship between the applied electric power at the time of power supply and the rate of fluctuation in resistance value of the thermal head unit 32 after the power supply is repeated 1,000 times under a condition that the power supply cycle is 2,500 μs and the power-on time is a period of time obtained by subtracting each power-off time from the power supply cycle (2,500 ps). When the power-off time falls within the range of from 5 μs to 80 μs and the applied electric power is 0.15 W, the rate of fluctuation in resistance value is 0.5% or less. On the other hand, when the power-off time is 0 μs and the applied electric power is the same as above, that is, 0.15 W, the rate of fluctuation in resistance value is 2.5% or more.

Therefore, when the power-off time is exactly set to 0 seconds, the heating resistance element of the thermal head unit 32 is more quickly deteriorated. Thus, the first power-off time is set to a finite period of time (for example, 5 μs to 80 μs) close to 0 seconds but not to 0 seconds.

Figure 5A:
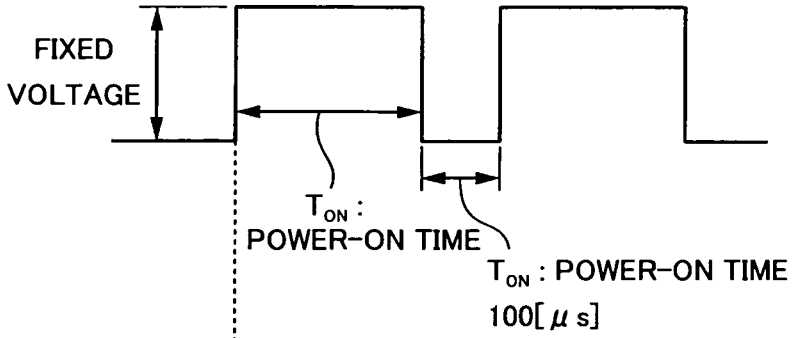
FIGS. 5A and 5B are diagrams illustrating an example of the printing pulses generated by the printing control unit when the voltage of the battery is high and when the voltage of the battery is low.
Figure 5B:
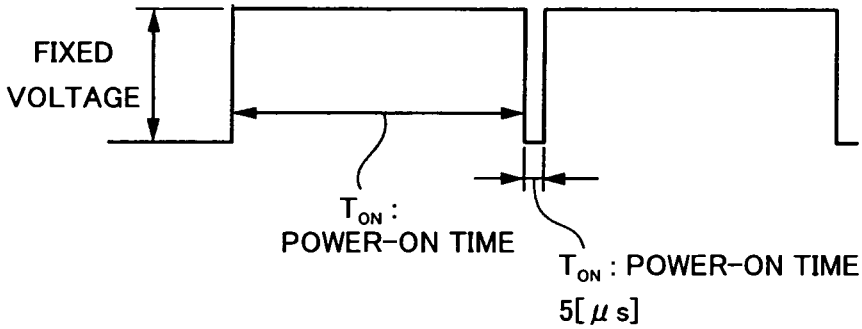

FIGS. 5A and 5B are diagrams illustrating an example of the printing pulses generated by the printing control unit 21 when the voltage of the battery 10 is high and when the voltage of the battery 10 is low. FIG. 5A illustrates a printing pulse generated when the voltage of the battery 10 is high. In FIG. 5A, the axis of abscissa represents time, and the axis of ordinate represents a voltage. Further, the power-off time is 100 [is].

FIG. 5B illustrates a printing pulse generated when the voltage of the battery 10 is low. In FIG. 5B, the axis of abscissa represents time, and the axis of ordinate represents a voltage. Further, the power-off time is 5 [μs].

As illustrated in FIGS. 5A and 5B, the printing control unit 21 calculates the electric power from the voltage of the battery 10 using the expression (2), and calculates the power-off time from the electric power calculated using the expression (1). The printing control unit 21 generates the printing pulse using the calculated power-off time. In other words, the printing control unit 21 generates the printing pulse based on the voltage of the battery 10.

Figure 6:
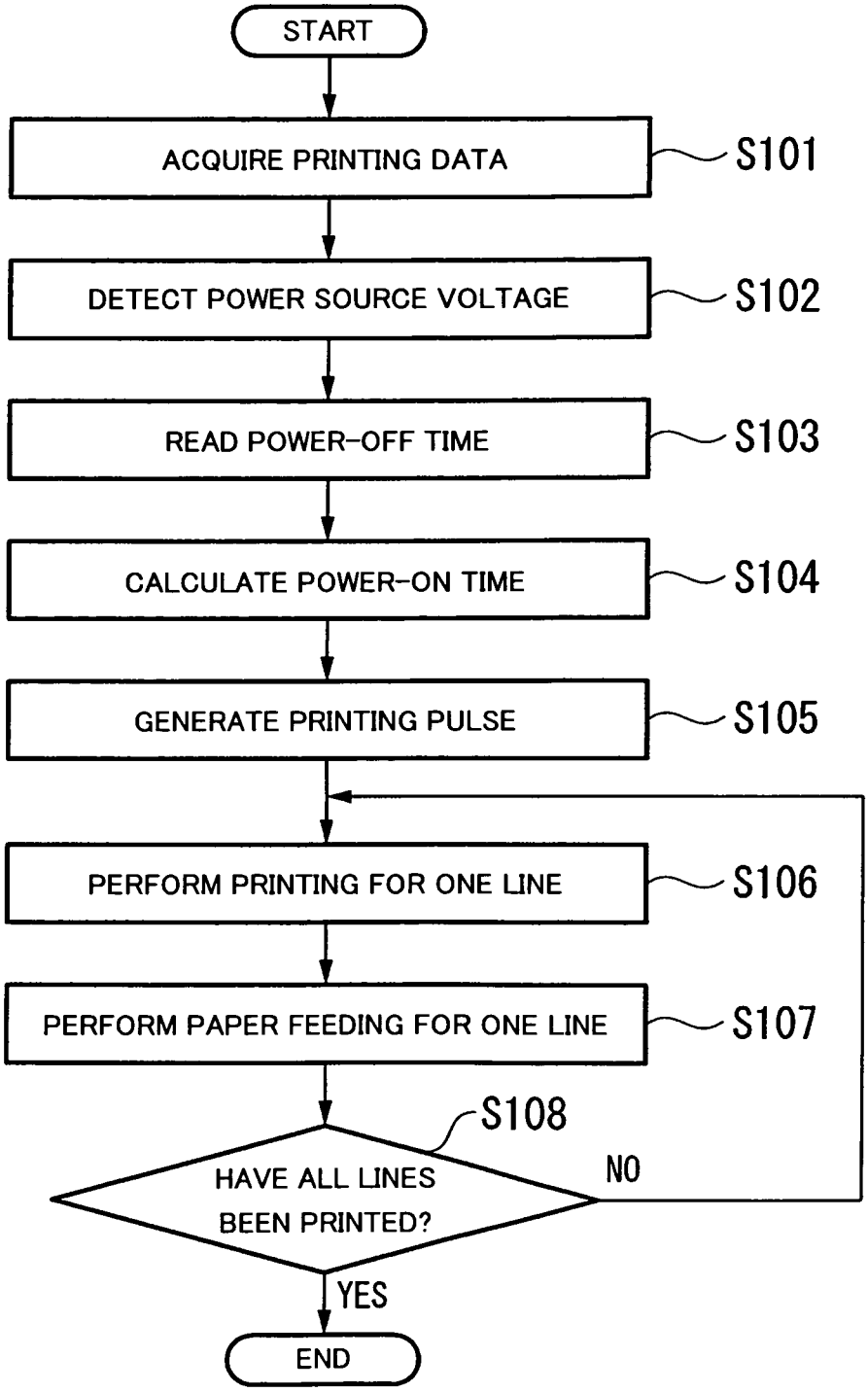
FIG. 6 is a flow chart illustrating a flow of processing of the printing apparatus according to the embodiment of the present invention.

FIG. 6 is a flow chart illustrating a flow of processing of the printing apparatus 1 according to the embodiment of the present invention. First, the printing control unit 21 acquires printing data that is input from the outside and stored in the data buffer 11 (Step S101). Subsequently, the battery voltage detecting unit 13 detects a voltage of the battery 10, and outputs, to the printing control unit 21, information indicating the voltage of the battery 10 (Step S102). Subsequently, the printing control unit 21 reads, from the storage unit 20, information indicating a power-off time according to the information indicating the voltage of the battery 10 that is input from the battery voltage detecting unit 13 (Step S103).

Subsequently, the printing control unit 21 calculates a power-on time by the above-mentioned expression (3) (Step S104). Subsequently, in order to supply a voltage to each heating resistance element of the thermal head unit 32, the printing control unit 21 uses the read information indicating the power-off time and the calculated power-on time, to thereby generate a printing pulse for each heating resistance element. The printing control unit 21 outputs the generated printing pulse to the driver unit 31 (Step S105).

Subsequently, the printing unit 30 performs printing for one line based on the input printing pulse (Step S106). Subsequently, the printing control unit 21 controls the drive unit 40 to perform paper feeding for one line (Step S107).

Subsequently, the printing control unit 21 determines whether or not all the lines of the acquired printing data are printed (Step S108). When not all the lines of the acquired printing data are printed (NO in Step S108), the printing control unit 21 returns to the processing of Step S106. On the other hand, when all the lines of the acquired printing data are printed (YES in Step S108), the printing control unit 21 finishes the processing. Through the above-mentioned steps, the processing of this flow chart is finished.

In the above-mentioned manner, as the voltage of the battery 10 becomes higher, the power-off time can be changed to a longer value. Thus, it is possible to reduce the load on the heating resistance element of the thermal head unit 32 even when the voltage of the battery 10 is high. As a result, it is possible to maintain the life of the heating resistance element.

On the other hand, when the voltage of the battery 10 is dropped, the power-off time can be shortened according to the dropped voltage of the battery 10. Thus, it is possible to increase the printing speed and shorten the overall printing time.

Further, the power-off time can be shortened when the voltage of the battery 10 is dropped, resulting in a shorter period of time for the temperature of the heating resistance element of the thermal head unit 32 to spontaneously decrease. Thus, the power-on time can be shortened. Accordingly, the printing control unit 21 can enhance the thermal efficiency of the heating resistance element of the thermal head.

Note that, in the embodiment of the present invention, the power-off time is expressed by the linear function of the electric power calculated based on the voltage of the battery 10, but the present invention is not limited thereto. Alternatively, the power-off time may be expressed by a quadratic or higher-order function of the electric power calculated based on the voltage of the battery 10. Further, the power-off time may be expressed by a function of the voltage of the battery 10.

The above-mentioned coefficients of the function only need to be determined so that, when the voltage of the battery 10 is a predetermined value, the power-off time takes the first power-off time that is close to 0 seconds, and when the voltage of the battery 10 is higher than the predetermined value, the power-off time takes the second power-off time that is longer than the first power-off time.

Further, the functions of the printing control unit 21 in the printing apparatus 1 of this embodiment may be implemented by a computer. In this case, a printer program for implementing the functions may be recorded on a computer-readable recording medium, and the functions may be implemented by a computer system reading and executing the printer program recorded on the recording medium. Note that, the "computer system" herein includes an operating system (OS) and hardware such as peripheral devices. Further, the "computer-readable recording medium" refers to a portable recording medium such as a flexible disk, a magneto-optical disk, an optical disc, and a memory card, or a storage device such as a hard disk integrated in the computer system. Further, the "computer-readable recording medium" may include a medium for dynamically holding a program for a short period of time, such as a communication line to be used for transmitting a program, including a network such as the Internet or a telephone line, and may further include a medium for holding a program for a given period of time, such as a volatile memory in a computer system serving as a server or a client in the case of using the above-mentioned communication line. Further, the above-mentioned program may implement only part of the functions described above, or alternatively, may implement the functions described above in combination with a program that is already recorded in the computer system.

Hereinabove, the embodiment of the present invention has been described in detail with reference to the accompanying drawings, but the specific configuration is not limited to this embodiment, and the present invention also encompasses design and the like that do not depart from the gist of the present invention.

What is claimed is:

1. A printing apparatus, comprising:

a printing unit for performing printing by pressing a thermal head onto heat sensitive paper to heat the heat sensitive paper;

a power source unit for supplying a voltage to the thermal head;

a voltage detecting unit for detecting the voltage of the power source unit; and a printing control unit for changing, according to the detected voltage, a power-off time in which power supply from the power source unit to the thermal head is stopped;

wherein the printing control unit shortens the power-off time as the detected voltage becomes lower.

2. A printing apparatus according to claim 1, wherein the printing control unit calculates the power-off time based on the detected voltage and a resistance of the thermal head.

3. A printing apparatus according to claim 2, wherein the printing control unit calculates electric power based on the detected voltage and the resistance of the thermal head, and calculates the power-off time using a linear function of the electric power.

4. A printing apparatus, comprising:

a printing unit for performing printing by pressing a thermal head onto heat sensitive paper to heat the heat sensitive paper;

a power source unit for supplying a voltage to the thermal head;

a voltage detecting unit for detecting the voltage of the power source unit; and a printing control unit for, changing, according to the detected voltage, a power-off time in which power supply from the power source unit to the thermal head is stopped;

wherein the printing control unit calculates the power-off time based on the detected voltage and a resistance of the thermal head.

5. A printing apparatus according to claim 4, wherein the printing control unit calculates electric power based on the detected voltage and the resistance of the thermal head, and calculates the power-off time using a linear function of the electric power.

* * * * *